US006616398B2

(12) United States Patent
Dershem et al.

(10) Patent No.: US 6,616,398 B2
(45) Date of Patent: Sep. 9, 2003

(54) LIFT BOOM ASSEMBLY

(75) Inventors: Brian R. Dershem, Sanford, NC (US); David D. Henderson, Sanford, NC (US)

(73) Assignee: Caterpillar S.A.R.L., Geneva ( * ) Notice: Subject to any disclaimer, the term of this patent is extended or adjusted under 35 U.S.C. 154(b) by 0 days.

(21) Appl. No.: 09/726,278

(22) Filed: Nov. 30, 2000

(65) Prior Publication Data

US 2002/0064445 A1 May 30, 2002

(51) Int. Cl.[7] ..... B66C 23/00

(52) U.S. Cl. ..... 414/686; 414/917

(58) Field of Search ..... 414/686, 685, 414/680, 706, 697, 917

(56) References Cited

U.S. PATENT DOCUMENTS

| | | | |
|---|---|---|---|
| 1,863,696 | A | 6/1932 | North et al. |
| 2,310,284 | A | 2/1943 | Gurries |
| 2,345,620 | A | 4/1944 | Mork |
| 2,372,220 | A | 3/1945 | Mork |
| 2,455,474 | A | 12/1948 | Drott et al. |
| 2,774,496 | A | 12/1956 | Dorkins |
| 2,833,360 | A | 5/1958 | Spanjer |
| 2,849,132 | A | 8/1958 | Clarke |
| 2,914,201 | A | 11/1959 | Krieger |
| 2,980,271 | A | 4/1961 | Ulinski |
| 3,175,711 | A | 3/1965 | Granryd |
| 3,215,292 | A | 11/1965 | Halls |
| 3,237,795 | A | 3/1966 | Kromer |
| 3,352,441 | A | 11/1967 | Alden |
| 3,522,898 | A | 8/1970 | Rotheisler |
| 3,586,195 | A | 6/1971 | Beltrami |
| 3,794,191 | A | 2/1974 | Kuhn |
| 3,963,131 | A | 6/1976 | Dimmer |
| 4,055,262 | A | 10/1977 | Bauer et al. |
| 4,122,960 | A | 10/1978 | Bauer et al. |
| 4,162,873 | A | 7/1979 | Smith, Jr. |
| 4,295,779 | A | 10/1981 | Shumaker |
| 4,318,664 | A | 3/1982 | Gibert |
| 4,355,946 | A | 10/1982 | Wykhuis et al. |
| 4,388,038 | A | 6/1983 | Freitag |
| 4,405,280 | A | 9/1983 | Cochran et al. |
| 4,427,334 | A | 1/1984 | Copie et al. |
| 4,636,133 | A | 1/1987 | Hess |
| 4,699,560 | A | 10/1987 | Ostermeyer et al. |
| 4,705,449 | A | 11/1987 | Christianson et al. |
| 4,808,061 | A | 2/1989 | Cook et al. |

(List continued on next page.)

FOREIGN PATENT DOCUMENTS

| | | |
|---|---|---|
| GB | 2 278 826 | 12/1994 |

OTHER PUBLICATIONS

Nicholas P. Chironis "Mechanisms, Linkages, and Mechanical Control", Copyright 1965 by McGraw–Hill, Inc.

*Primary Examiner*—Donald W. Underwood
(74) *Attorney, Agent, or Firm*—Diana L Charlton

(57) ABSTRACT

A lift boom assembly includes a pair of lift arm assemblies. Each of the lift arm assemblies include a main lift link with a rear end portion and a second lift link. The second lift links each have a first end portion, a second end portion pivotally connected to a frame of a work machine to define a first pivot, and a central portion pivotally connected to the rear end portion of a respective main lift link to define a second pivot. A pair of control links each having a first end portion that is pivotally connected to the frame of the work machine to define a third pivot. A second end portion of the control links being pivotally connected to a respective one of the main lift links to define a fourth pivot with each of the first, second, third, and fourth pivots being located above the lower portion of the frame. The pivots of the components are located on an upper portion of the work machine so that the components cooperate together to achieve a simple and efficient lift boom design.

26 Claims, 4 Drawing Sheets

U.S. PATENT DOCUMENTS

| | | | | |
|---|---|---|---|---|
| 4,844,685 | A | | 7/1989 | Sagaser |
| 5,169,277 | A | | 12/1992 | Orser et al. |
| 5,169,278 | A | | 12/1992 | Hoechst et al. |
| 5,171,124 | A | | 12/1992 | Foster |
| 5,184,932 | A | | 2/1993 | Misuda et al. |
| 5,192,179 | A | | 3/1993 | Kovacs |
| 5,240,366 | A | | 8/1993 | Bamford |
| 5,470,190 | A | | 11/1995 | Bamford et al. |
| 5,511,932 | A | | 4/1996 | Todd et al. |
| 5,518,358 | A | | 5/1996 | Aschroft et al. |
| 5,520,500 | A | * | 5/1996 | McIlwain et al. ..... 414/685 |
| 5,542,814 | A | | 8/1996 | Ashcroft et al. |
| 5,553,992 | A | | 9/1996 | Ashcroft |
| 5,609,464 | A | | 3/1997 | Moffitt et al. |
| 5,615,991 | A | | 4/1997 | Chung |
| 5,634,762 | A | | 6/1997 | Kim |
| 5,807,061 | A | | 9/1998 | Donoghue et al. |
| 5,918,694 | A | | 7/1999 | Miller et al. |
| 5,964,567 | A | | 10/1999 | Bamford |
| 6,132,163 | A | * | 10/2000 | Andrews et al. ..... 414/685 |

* cited by examiner

LIFT BOOM ASSEMBLY

TECHNICAL FIELD

This invention relates generally to a lift boom assembly for a machine and, more particularly, to a linkage used in the lift boom assembly to maintain a substantially vertical linear path between upward and downward movement of a boom assembly thereof.

BACKGROUND ART

It is well known that when conventional lift boom assemblies, mounted at a single pivot axis to a loader frame are raised and lowered, the outer forward ends travel in an arc. When a boom thereof starts to raise, there is forward movement of a supported implement, and, after the pivoting boom goes over center, there is a substantial amount of upward and rearward movement of the implement. This movement tends to shorten the forward reach of the implement when the boom is in a raised position. Therefore, lift boom assemblies for a machine, such as a front-end loader backhoe or skid steer loader, that attempt to control the vertical linear displacement during movement of the boom are well known in the art.

One such example is disclosed in U.S. Pat. No. 5,169,278 issued on Dec. 8, 1992 to Lonnie D. Hoechst, et al. In this patent, a loader boom assembly has articulated lift arms with main and rear lift arm sections pivotally mounted together. The rear lift arm section is pivotally mounted to rear portions of a prime mover frame. The main lift arm section is substantially longer than the rear lift arm section and pivots on the outer end of a rear lift arm link. The lift arm sections are in a folded position when the lift arms are lowered, and a control link is provided to cause the lift arms to unfold as the lift arms are raised to keep the forward portion of the main lift arm section moving along a generally vertical path after a selected lift height. Unfortunately, a first end of the control link is connected adjacent forward portions of the main frame while a second end of the control link extends rearwardly and is pivotally connected to the main lift arm section. In this type of configuration, additional structure must be used at the forward portions of the main frame to support the loads incurred during the movement of the loader boom assembly. Additionally, the length of the control arm is substantially greater than the rear lift link and must be substantial to reach the forward portions of the main frame which increases the likelihood of buckling of the control arms.

Another example is disclosed in U.S. Pat. No. 5,609,464 issued on Mar. 11, 1997 to John M. Moffitt, et al. In this patent, a lift boom assembly includes a pair of laterally spaced, interconnected lift arms having a tool mounted between forward ends thereof. Each lift arm includes a main lift link having upper and lower connecting portions at a rear end thereof. A second lift link is pivotally connected to the upper connecting portion of the main lift link and partially controls movements of the respective lift arm. The opposite end of each second lift link is pivotally connected to a frame of a machine on which the lift assembly is mounted. Movement of the lift arms is further controlled by a pair of control arms. A lower end of each control arm is pivotally connected to the frame. When the boom assembly is in a lowered position relative to the frame, a second or upper end of each control arm extends upwardly and rearwardly from the lower end and is pivotally connected to the lower connecting portion of the respective main lift link. In response to vertical movements of the boom assembly between raised and lowered positions, each control arm swings forwardly and rearwardly of its true vertical position to alter the movements of the lift arms and such that the tool is elevationally moved along a generally linear vertical path. A pair of extendable and retractable drivers provide powered vertical movements to the lift assembly and the tool carried relative to the frame. In this patent, the length of the control arms is again substantially greater than the second lift links which increases the likelihood of control arm buckling. Additionally, the use of the first and second connecting portions of the main lift link for connection with the second lift links and control arms, respectively, requires that the lift arms be manufactured in a manner that increases the weight of the lift arms and the complexity of the design. Therefore, a lift boom assembly that is simple and efficient is needed.

The present invention is directed to overcoming one or more of the problems as set forth above.

DISCLOSURE OF THE INVENTION

In one aspect of the present invention, a lift boom assembly is movable between lowered and raised positions and is adapted for use on a work machine. The work machine has a longitudinal centerline, a frame with front and rear end portions including respective front and rear drive axes and upper and lower portions. The lift boom assembly comprises a pair of supports connected to the rear end portion of the frame for supporting the lift boom assembly. A pair of lift arm assemblies are positioned on opposite sides of the longitudinal centerline and are pivotally connected to a respective support. Each of the lift arm assemblies include a main lift link with front and rear end portions and a second lift link. The second lift links each have a first end portion, a second end portion pivotally connected to a respective one of the supports to define a first pivot, and a central portion located between the first and second end portions and pivotally connected to the rear end portion of a respective main lift link to define a second pivot. A pair of extendible and retractable hydraulic actuators are disposed on opposite sides of the longitudinal centerline and connectable between the frame and a respective lift arm assembly for moving the lift boom assembly between the lowered and raised positions. A pair of control links that each have first and second end portions. The first end portion of each of the control links are pivotally connected to a respective one of the supports to define a third pivot. The second end portion of each of the control links are pivotally connected to a respective one of the main lift links to define a fourth pivot. Each of the first, second, third, and fourth pivots are located above the lower portion of the frame.

In another aspect of the present invention, a lift boom assembly is movable between lowered and raised positions and is adapted for use on a work machine. The work machine has a longitudinal centerline, a frame with front and rear end portions including respective front and rear drive axes and upper and lower portions. The lift boom assembly comprises a pair of supports connected to the rear end portion of the frame for supporting the lift boom assembly. A pair of lift arm assemblies are positioned on opposite sides of the longitudinal centerline and are pivotally connected to a respective support. Each of the lift arm assemblies include a main lift link with front and rear end portions and a second lift link. The second lift links each have a first end portion, a second end portion pivotally connected to a respective one of the supports, and a central portion located between the first and second end portions and pivotally connected to the rear end portion of a respective main lift link. A pair of extendible and retractable hydraulic actuators are disposed on opposite sides of the longitudinal centerline and are connected between the frame and a respective lift arm assembly for moving the lift boom assembly between the lowered and raised positions. A pair of control links that each have first and second end portions. The first end portion of each of the control links are pivotally connected to a respective one of the supports. The second end portion of each of the control links are pivotally connected to a respective one of the main lift links. The second end portion of each of the control links extend downwardly and rearwardly from the first end portion of the control links when the lift boom assembly is in the lowered position and upwardly and rearwardly from the first end portion of the control links when the lift boom assembly is in the raised position.

In yet another aspect of the present invention, a work machine has a longitudinal centerline, a frame with front and rear end portions including respective front and rear drive axes and upper and lower portions. The work machine comprises a pair of supports that are connected to the rear end portion of the frame for supporting the lift boom assembly. A pair of lift arm assemblies are positioned on opposite sides of the longitudinal centerline and pivotally connected to a respective support. Each of the lift arm assemblies include a main lift link with front and rear end portions, a mounting brace located beneath and extending from each of the main lift links and located between the front and rear end portions of each of the main lift links, and a second lift link. The second lift links each have a first end portion, a second end portion pivotally connected to a respective one of the supports to define a first pivot, and a central portion located between the first and second end portions and pivotally connected to the rear end portion of a respective main lift link to define a second pivot. A pair of extendible and retractable hydraulic actuators disposed on opposite sides of the longitudinal centerline and connectable between the frame and a respective lift arm assembly for moving the lift boom assembly between the lowered and raised positions. A pair of control links that each have first and second end portions. The first end portion of each of the control links are pivotally connected to a respective one of the supports to define a third pivot. The second end portion of each of the control links being pivotally connected to a respective one of the mounting braces to define a fourth pivot. Each of the first, second, third, and fourth pivots are located above the lower portion of the frame.

The present invention utilizes a lift boom assembly with components having pivots positioned at precise locations on the upper portion of a work machine that cooperate together to achieve a simple and efficient design.

BEST MODE FOR CARRYING OUT THE INVENTION

Figure 1:
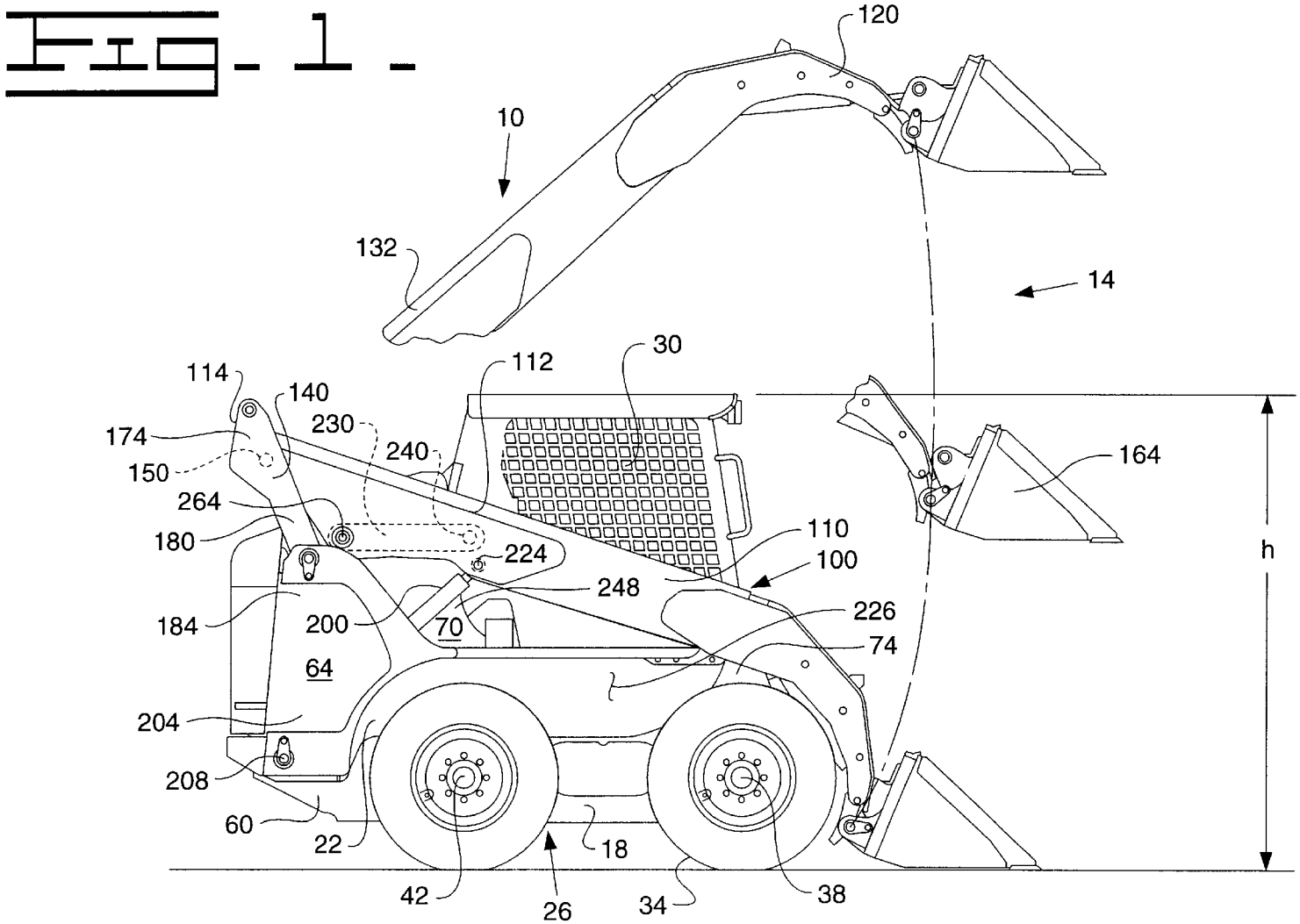
FIG. 1 is a part-schematic side elevational showing a lift boom assembly with an implement attached thereon in a plurality of positions to illustrate the path of movement thereof in accordance with the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

With reference to FIGS. 1–4, the present invention incorporates a lift boom assembly 10 adapted for use on a work machine 14, such as a front end loader backhoe or skid steer loader. In the illustrated embodiment, a skid steer loader is shown with a lower frame assembly 18 and an upper frame assembly 22 which are mounted together to define a main frame assembly 26. The work machine 14 is controlled by an operator (not shown) from within an operator's compartment 30 through a control device (not shown). The operator (not shown) controls the work machine 14 in a specific manner to achieve independent movement of a plurality of wheels, one of which is shown at 34, that support the main frame assembly 26 in a well known manner. The wheels 34 are located on respective sides of a longitudinal centerline 36 (seen in FIG. 4) of the work machine 14. The wheels 34 are connected with front and rear axles 38,42 with a respective drive axis 44,46 that are driven in a well known manner. Although a work machine 14 is disclosed herein with wheels 34 and front and rear axles 38,42, it should be understood that a work machine supported on a tracked undercarriage may also incorporate and be within the scope of the present invention.

Figure 2:
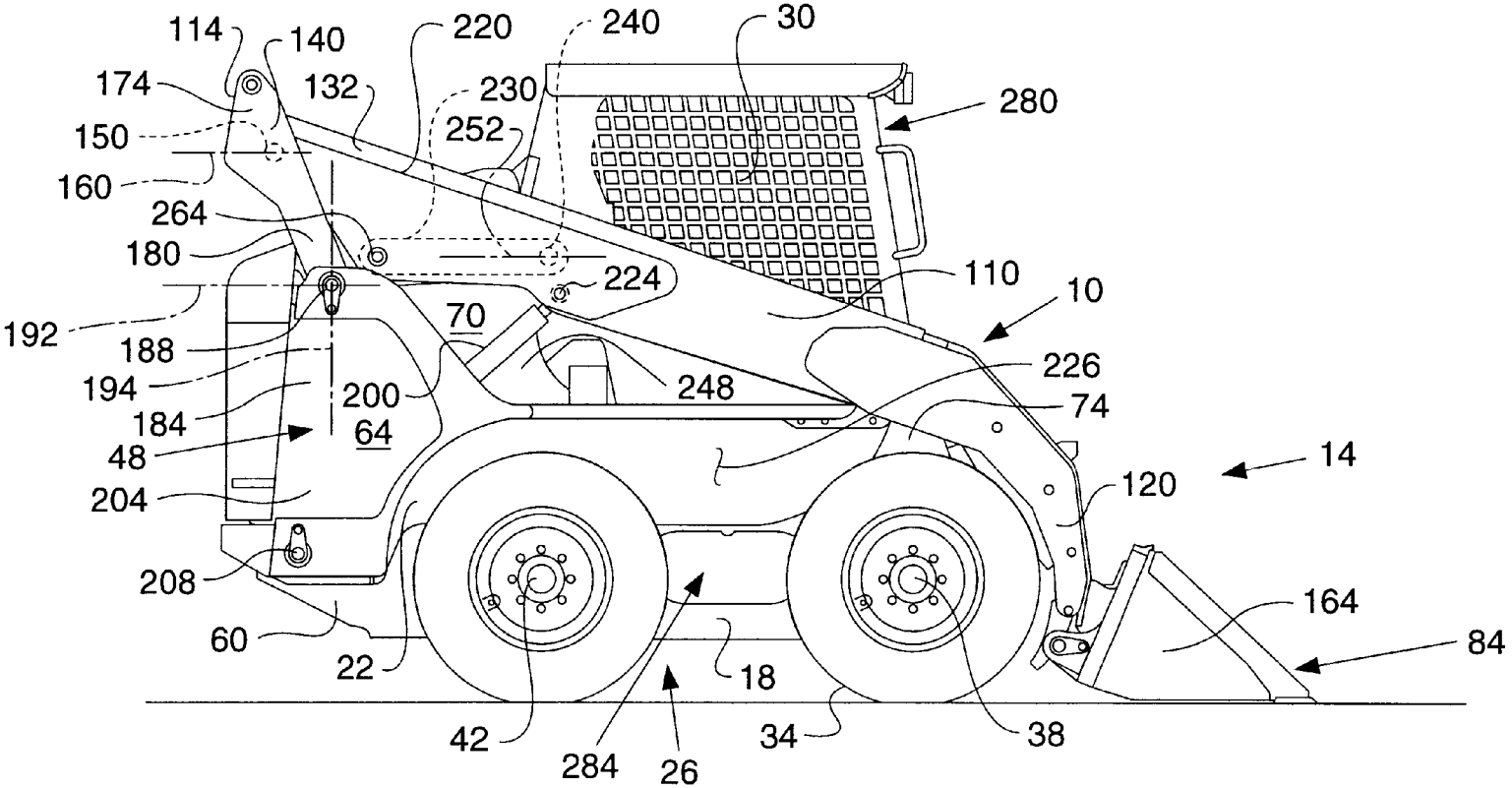
FIG. 2 is a side elevational view of the lift boom assembly in a lower position.
Figure 3:
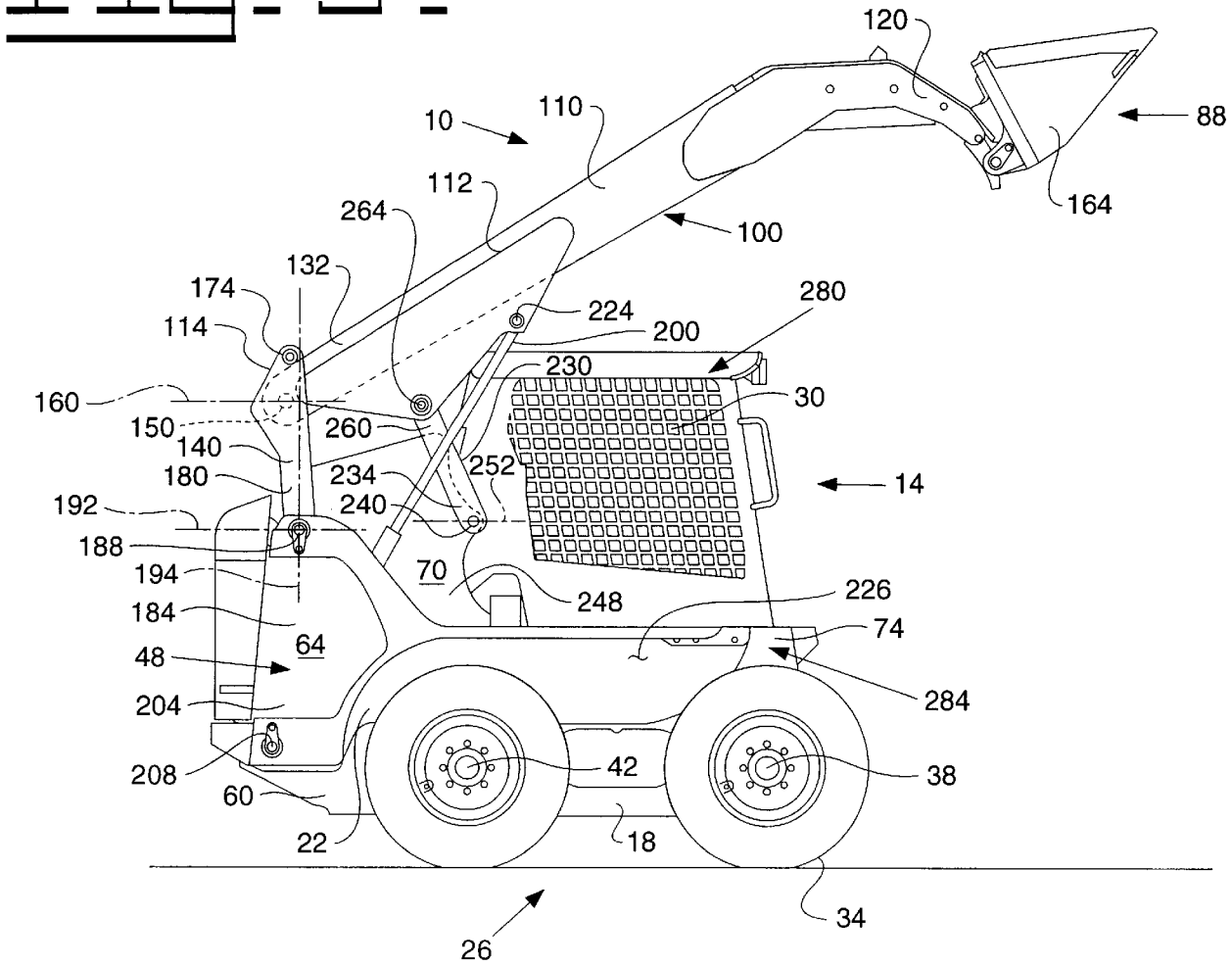
FIG. 3 is a side elevational view of the lift boom assembly in a raised position with a portion of a tower assembly cut-away for clarity.
Figure 4:
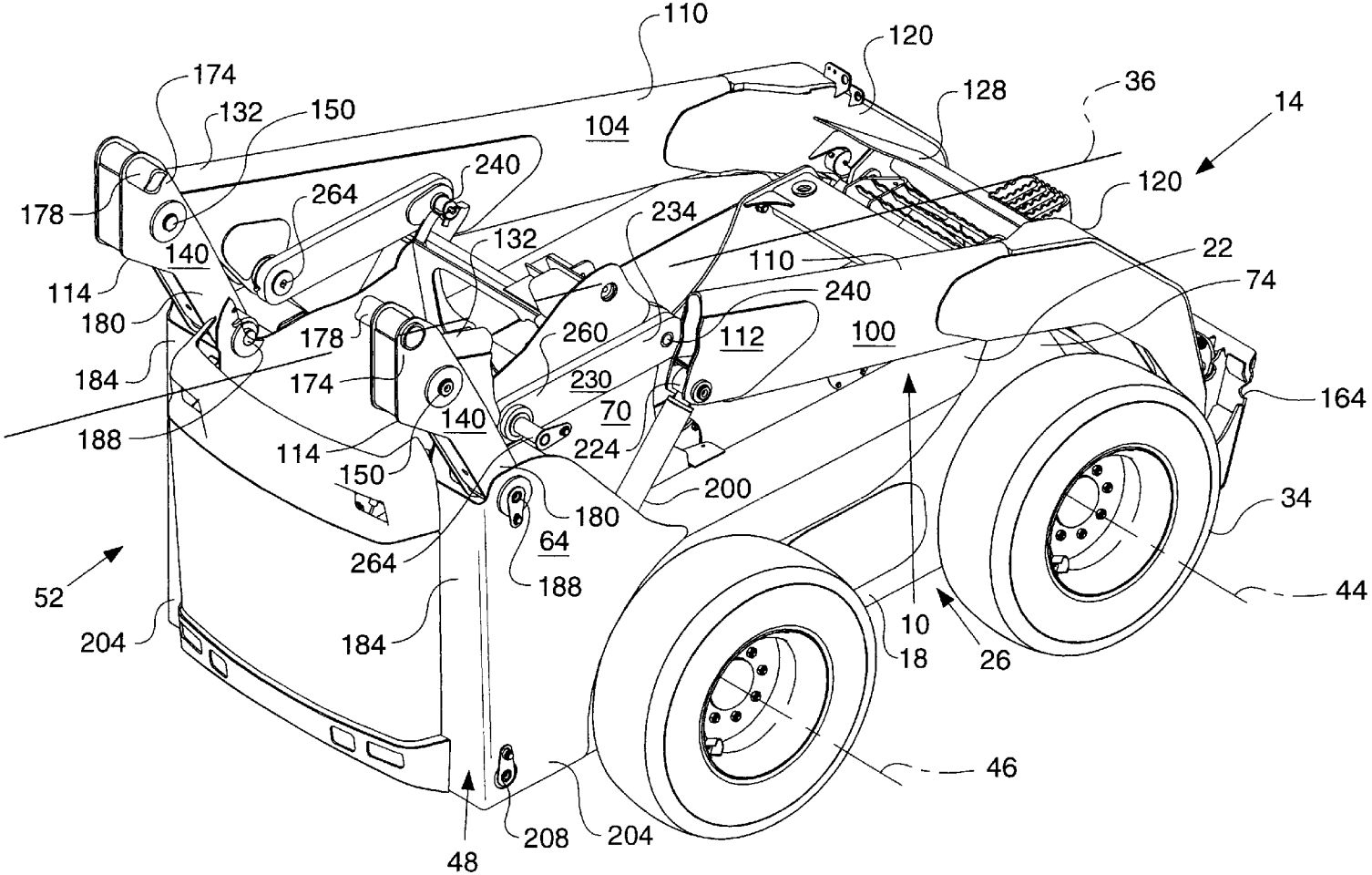
FIG. 4 is a schematic perspective view of the lift boom assembly.

A pair of spaced tower assemblies 48,52, seen best in FIG. 4, are included with the upper frame assembly 22 and are positioned on opposite sides of the longitudinal centerline 36 at a rear end portion 60 of the work machine 14. Each of the tower assemblies 48,52 includes a pair of spaced apart plates 64,70. The plate 70 extends substantially forwardly of the plate 64 toward a front end portion 74 of the work machine 14. The lift boom assembly 10 is movable between lowered and raised positions 84,88, as seen in FIGS. 2 & 3, respectively, and includes a pair of lift arm assemblies 100,104 that are pivotally connected with a respective tower assembly 48,52.

Each lift arm assembly 100,104 includes a main lift link 110, a mounting brace 112 located beneath and extending from the main lift link 110, and a second lift link 114.

The main lift links 110 are connected together at a front end 120 thereof in any suitable manner, such as with crossmember 128. The main lift links 110 each have a rear end 132 for pivotal connection at a respective central portion 140 of the second lift link 114 at pivot pins 150 (L PINS) to define pivots with a horizontal plane 160 defined therethrough (seen in FIGS. 2 & 3). The mounting braces 112 are located between the front and rear ends 120,132 of the main lift links 110. An implement 164 is disposed adjacent the front end portion 74 of the work machine 14 in connection with the front end 120 of the main lift links 110.

The second lift links 114 are connected at first ends 174 thereof in any suitable manner, such as with crossmember 178. The second lift links 114 have a second end 180 pivotally connected to an upper portion 184 of a respective tower assembly 48,52 between plates 64,70 at pivot pins 188 (M PINS) to define pivots with horizontal and vertical planes 192,194 defined therethrough (seen in FIGS. 2 & 3). The first and second ends 174,180 of the second lift links 114 are disposed on opposite sides of the central portion 140. In the lowered position 84 of the lift boom assembly 10, the second lift links 114 extend upwardly and rearwardly from their pivots at the tower assemblies 48,52 to their pivots at the rear end 132 of the main lift links 110.

A pair of extendible and retractable hydraulic actuators, one of which is shown at 200, are mounted on opposite sides of the longitudinal centerline 36 of the work machine 14. The hydraulic actuators 200 are pivotally connected at one end to a lower portion 204 of a respective tower assembly 48,52 at pivot pins 208 (Y PINS) to define a pivot. The hydraulic actuators 200 are pivotally connected at an opposite end to a respective forward end of the mounting brace 112 by pivot pins 224 (K PINS) to define a pivot. The pivots of the hydraulic actuators 200 to the mounting braces 112 are forward of the rear axle 42 and rearward of a central portion 226 of the work machine 14 defined between the front and rear end portions 74,60 thereof.

A pair of control links 230 that are shorter than the main and second lift links 110,114 are mounted on opposite sides of the longitudinal centerline 36 of the work machine 14. The control links 230 each have a first end 234 pivotally connected by pivot pins 240 (N PINS) to a respective tower assembly 48,52 at a forward portion 248 of plate 70 to define pivots with a horizontal plane 252 defined therethrough (seen in FIGS. 2 & 3). A second end 260 of the control links 230 are pivotally connected at pivot pins 264 (A PINS) to a rearward end of a respective mounting brace 112 to define a pivot. The pivots of the control links 230 to the tower assemblies 48,52 are forward of the drive axis 46 of the rear axle 42 and rearward of the central portion 226 of the work machine 14. The distance between pivot pins 240 and pivot pins 264 is substantially equal to the distance between the pivot pins 150 and pivots pins 188.

The pivots of the second lift links 114 to the tower assemblies 48,52 at pivot pins 188 and the pivots of the control links 230 to the mounting braces 112 at pivot pins 264 and the pivots of the second lift links 114 to the main lift links 110 at pivot pins 150 and the pivots of the hydraulic actuators 200 to the mounting braces 112 at pivot pins 224 and the pivots of the control links 230 to the tower assemblies 48,52 at pivot pins 240 are all located at an upper portion 280 of the work machine 14 above a lower portion 284 thereof at a vertical height at least one-half of the height (h) of the work machine 14 or greater.

INDUSTRIAL APPLICABILITY

Referring more specifically to FIGS. 1–2 where the lift boom assembly is in the lowered position 84, the control links 230 extend rearwardly and downwardly from their pivots at the tower assemblies 48,52 to their pivots at the mounting braces 112 so that the pivot pin 264 is positioned below the horizontal plane 252. It should be understood that the pivot pins 264 may also be positioned on the horizontal plane 252 at the same height as the pivots at the tower assemblies 48,52 and still be within the scope of the present invention. Also, the control links 230 are positioned between horizontal planes 160 & 192. Further, the pivots of the control links 230 at the first and second ends 234,260 are located above and rearward of the pivots of the hydraulic actuators 200 at the ends thereof. The pivots of the second lift links 114 to the tower assemblies 48,52, respectively, at pivot pins 188 are rearward of the pivots of the control links 230 to the mounting braces 112 at pivot pins 264 but forward of the pivots of the second lift links 114 to the main lift links 110 at pivot pin 150. Additionally, the pivots of the second lift links 114 to the main lift links 110 are rearward of the vertical plane 194.

Referring more specifically to FIGS. 1 & 3, when the lift boom assembly 10 is initially moved from the lowered position 84 by the hydraulic actuators 200, the second lift links 114 are pivoted rearward about pivot pins 188 a predetermined distance. Simultaneously, the control links 230 are pivoted upward from a position downward of their true horizontal position about pivot pins 240. Upon further movement of the lift boom assembly 10 to the raised position 88, the second lift links 114 are pivoted forward about pivot pins 188. However, the pivots of the second lift links 114 to the main lift links 110 remain slightly rearward of the vertical plane 194.

Throughout movement of the lift boom assembly 10 between the lowered and raised positions 84,88, the pivots of the second lift links 114 to the tower assemblies 48,52 at pivot pins 188 are located vertically below both the pivots of the control links 230 to the mounting braces 112 and tower assemblies 48,52 at pivot pins 264 & 240, respectively, and the pivots of the second lift links 114 to the main lift links 110 at pivot pins 150 so that the horizontal plane 192 is vertically below the horizontal plane 252. However, it should be understood that the pivots of the second lift links 114 to the tower assemblies 48,52 at pivot pins 188 may be located at the same height as both the pivots of the control links 230 to the mounting braces 112 and tower assemblies 48,52 at pivot pins 264 & 240, respectively, and the pivots of the second lift links 114 to the main lift links 110 at pivot pins 150. Further, the pivots of the hydraulic actuators 200 to the tower assemblies 48,52 at pivot pins 208 are spaced below the pivots of the control links 230 to the tower assemblies 48,52.

The pivots of the second lift links 114 to the tower assemblies 48,52 at pivot pins 188 and the pivots of the control links 230 to the mounting braces 112 at pivot pins 264 and the pivots of the second lift links 114 to the main lift links 110 at pivot pins 150 and the pivots of the hydraulic actuators 200 to the tower assemblies 48,52 at pivot pins 208 are all rearward of the rear drive axis 46 of the rear axle 42.

The present invention utilizes components 110,114,230 with pivots located at precise locations on the upper portion 280 of the work machine 14 that cooperate together to achieve an efficient lift boom design through the use of short links (114,230) that provide high stiffness. The orientation and connection of the components and the associated pivots ensure that the lift path for the lift boom assembly 10 arcs forwardly from the lowered position 84 to a maximum reach in the lower half of the lift range and is followed by a nearly linear path slightly rearward from the true vertical angle to compensate for load pressure on the wheels 34 (squash) during heavy lifting to the raised position 88.

Other aspects, objects, and features of the present invention can be obtained from a study of the drawings, the disclosure, and the appended claims.

What is claim is:

1. A lift boom assembly movable between lowered and raised positions and adapted for use on a work machine having a longitudinal centerline, a frame with front and rear end portions and upper and lower portions with the front and rear end portions including respective front and rear drive axes, comprising:

a pair of supports connectable to the rear end portion of the frame for supporting the lift boom assembly;

a pair of lift arm assemblies positionable on opposite sides of the longitudinal centerline and pivotally connected to a respective support, each of the lift arm assemblies including a main lift link with front and rear end portions and a second lift link, the second lift links each having a first end portion, a second end portion pivotally connected to a respective one of the supports to define a first pivot, and a central portion located between the first and second end portions and pivotally connected to the rear end portion of a respective main lift link to define a second pivot;

a pair of extendible and retractable hydraulic actuators disposable on opposite sides of the longitudinal centerline and connectable between the frame and a respective lift arm assembly for moving the lift boom assembly between the lowered and raised positions; and a pair of control links with each having first and second end portions, the first end portion of each of the control links being pivotally connected to a respective one of the supports to define a third pivot and the second end portion of each of the control links being pivotally connected to a respective one of the main lift links to define a fourth pivot with each of the first, second, third, and fourth pivots being located above the lower portion of the frame at a vertical height that is at least one-half of the height of the work machine or greater.

2. The lift boom assembly of claim 1, wherein the control links are shorter than the second lift links and the respective distance between the first and second pivots and the third and fourth pivots are substantially equal.

3. The lift boom assembly of claim 1, wherein a vertical plane is defined through the first pivots, each of the second pivots of the second lift link being located rearwardly of the vertical plane when the lift boom assembly is in the lowered and raised positions, and each of the first pivots being located rearwardly of a respective fourth pivot but forwardly of a respective second pivot when the lift boom assembly is in the lowered and raised positions.

4. The lift boom assembly of claim 1, wherein each of the first, second, and fourth pivots are located rearward of the rear drive axis and each of the third pivots are located forward of the rear drive axis.

5. The lift boom assembly of claim 1, wherein a first horizontal plane is defined through the third pivots and each of the fourth pivots are located on or below the first horizontal plane when the lift boom assembly is in the lowered position.

6. The lift boom assembly of claim 5, wherein a second horizontal plane is defined through the first pivots, the second horizontal plane being positioned vertically below the first horizontal plane.

7. The lift boom assembly of claim 6, wherein a third horizontal plane is defined through the second pivots when the lift boom assembly is in the lowered position, each of the control links being positioned between the second and third horizontal planes when the lift boom assembly is in the lowered position and each of the first pivots being located vertically below the second and fourth pivots.

8. The lift boom assembly of claim 1, wherein a mounting brace is located beneath and extending from each of the main lift links and is located between the front and rear end portions of a respective main lift link, the second end portion of each of the control links being pivotally connected to a respective one of the main lift links at the mounting braces.

9. A lift boom assembly movable between lowered and raised positions and adapted for use on a work machine having a longitudinal centerline, a frame with front and rear end portions and upper and lower portions with the front and rear end portions including respective front and rear drive axes, comprising:

a pair of supports connectable to the rear end portion of the frame for supporting the lift boom assembly;

a pair of lift arm assemblies positionable on opposite sides of the longitudinal centerline and pivotally connected to a respective support, each of the lift arm assemblies including a main lift link with front and rear end portions and a second lift link, the second lift links each having a first end portion, a second end portion pivotally connected to a respective one of the supports, and a central portion located between the first and second end portions and pivotally connected to the rear end portion of a respective main lift link;

a pair of extendible and retractable hydraulic actuators disposable on opposite sides of the longitudinal centerline and connected between the frame and a respective lift arm assembly for moving the lift boom assembly between the lowered and raised positions; and a pair of control links with each having first and second end portions, the first end portion of each of the control links being pivotally connected to a respective one of the supports and the second end portion of each of the control links being pivotally connected to a respective one of the main lift links, the second end portion of the control links extending downwardly and rearwardly from the first end portion of the control links when the lift boom assembly is in the lowered position and upwardly and rearwardly from the first end portion of the control links when the lift boom assembly is in the raised position.

10. The lift boom assembly of claim 9, wherein a vertical plane is defined through the first pivots, each of the second pivots of the second lift link being located rearwardly of the vertical plane when the lift boom assembly is in the lowered and raised positions, each of the first pivots are located rearwardly of a respective fourth pivot but forwardly of a respective second pivot when the lift boom assembly is in the lowered and raised positions.

11. The lift boom assembly of claim 9, wherein each of the first, second, and fourth pivots are located rearward of the rear drive axis and each of the third pivots are located forward of the rear drive axis.

12. The lift boom assembly of claim 9, wherein a first horizontal plane is defined through the third pivots and each of the fourth pivots are located on or below the first horizontal plane when the lift boom assembly is in the lowered position.

13. The lift boom assembly of claim 12, wherein a second horizontal plane is defined through the first pivots, the second horizontal plane being positioned vertically below the first horizontal plane.

14. The lift boom assembly of claim 13, wherein a third horizontal plane is defined through the second pivots when the lift boom assembly is in the lowered position, each of the control links being positioned between the second and third horizontal planes when the lift boom assembly is in the lowered position and each of the first pivots being located vertically below the second and fourth pivots.

15. The lift boom assembly of claim 9, wherein a mounting brace is located beneath and extending from each of the main lift links and is located between the front and rear end portions of a respective main lift link, the second end portion of each of the control links being pivotally connected to a respective one of the main lift links at the mounting braces.

16. A work machine having a longitudinal centerline, a frame with front and rear end portions and upper and lower portions with the front and rear end portions including respective front and rear drive axes, comprising:

a pair of supports connected to the rear end portion of the frame for supporting the lift boom assembly;

a pair of lift arm assemblies positioned on opposite sides of the longitudinal centerline and pivotally connected to a respective support, each of the lift arm assemblies including a main lift link with front and rear end portions, a mounting brace located beneath and extending from each of the main lift links and located between the front and rear end portions of each of the main lift links, and a second lift link, the second lift links each having a first end portion, a second end portion pivotally connected to a respective one of the supports to define a first pivot, and a central portion located between the first and second end portions and pivotally connected to the rear end portion of a respective main lift link to define a second pivot;

a pair of extendible and retractable hydraulic actuators disposed on opposite sides of the longitudinal centerline and connectable between the frame and a respective lift arm assembly for moving the lift boom assembly between the lowered and raised positions; and a pair of control links with each having first and second end portions, the first end portion of each of the control links being pivotally connected to a respective one of the supports to define a third pivot and the second end portion of each of the control links being pivotally connected to a respective one of the mounting braces to define a fourth pivot with each of the first, second, third, and fourth pivots being located above the lower portion of the frame at a vertical height that is at least one-half of the height of the work machine or greater.

17. The work machine of claim 16, wherein the control links are shorter than the second lift links and the respective distance between the first and second pivots and the third and fourth pivots are substantially equal.

18. The work machine of claim 16, wherein the second end portion of the control links extend downwardly and rearwardly from the first end portion of the control links when the lift boom assembly is in the lowered position and upwardly and rearwardly from the first end portion of the control links when the lift boom assembly is in the raised position.

19. The work machine of claim 16, wherein a vertical plane is defined through the first pivots, each of the second pivots of the second lift link being located rearwardly of the vertical plane when the lift boom assembly is in the lowered position and raised positions, each of the first pivots being located rearwardly of a respective fourth pivot but forwardly of a respective second pivot when the lift boom assembly is in the lowered and raised positions.

20. The work machine of claim 16, wherein each of the first, second, and fourth pivots are located rearward of the rear drive axis and each of the third pivots are located forward of the rear drive axis.

21. The work machine of claim 16, wherein a first horizontal plane is defined through the third pivots and each of the fourth pivots are located on or below the first horizontal plane when the lift boom assembly is in the lowered position.

22. The work machine of claim 21, wherein a second horizontal plane is defined through the first pivots, the second horizontal plane being positioned vertically below the first horizontal plane.

23. The work machine of claim 22, wherein a third horizontal plane is defined through the second pivots when the lift boom assembly is in the lowered position, each of the control links being positioned between the second and third horizontal planes when the lift boom assembly is in the lowered position and each of the first pivots being located vertically below the second and fourth pivots.

24. A lift boom assembly movable between lowered and raised positions and adapted for use on a work machine having a longitudinal centerline, a frame with front and rear end portions and upper and lower portions, comprising:

a support connectable to the rear end portion of the frame for supporting the lift boom assembly;

a lift arm assembly pivotally connected to the support, the lift arm assembly including a main lift link with front and rear end portions and a second lift link, the second lift link having a first end portion, a second end portion pivotally connected to the support to define a first pivot, and a central portion located between the first and second end portions and pivotally connected to the rear end portion of the main lift link to define a second pivot;

an extendible and retractable actuator connectable between the frame and the lift arm assembly for moving the lift boom assembly between the lowered and raised positions; and a control link having first and second end portions, the first end portion of the control link being pivotally connected to the support to define a third pivot and the second end portion of the control link being pivotally connected to the main lift link to define a fourth pivot with each of the first, second, third, and fourth pivots being located above the lower portion of the frame at a vertical height that is at least one-half of the height of the work machine or greater.

25. A lift boom assembly movable between lowered and raised positions and adapted for use on a work machine, a frame with front and rear end portions and upper and lower portions, comprising:

a support connectable to the rear end portion of the frame for supporting the lift boom assembly;

a lift arm assembly pivotally connected to the support, the lift arm assembly including a main lift link with front and rear end portions and a second lift link, the second lift link having a first end portion, a second end portion pivotally connected to the support, and a central portion located between the first and second end portions and pivotally connected to the rear end portion of the main lift link;

an extendible and retractable actuator connected between the frame and the lift arm assembly for moving the lift boom assembly between the lowered and raised positions; and a control link having first and second end portions, the first end portion of the control link being pivotally connected to the support and the second end portion of the control link being pivotally connected to the main lift link, the second end portion of the control link extending downwardly and rearwardly from the first end portion of the control link when the lift boom assembly is in the lowered position and upwardly and rearwardly from the first end portion of the control link when the lift boom assembly is in the raised position.

26. A lift boom assembly movable between lowered and raised positions and adapted for use on a work machine having a longitudinal centerline, a frame with front and rear end portions and upper and lower portions, comprising:

a lift arm assembly pivotally connectable with the frame, the lift arm assembly including a main lift link and a second lift link, the second lift link being pivotally connectable with the frame to define a first pivot and pivotally connected to the main lift link to define a second pivot;

an actuator connectable between the frame and the lift arm assembly for moving the lift boom assembly between the lowered and raised positions; and a control link being pivotally connectable with the frame to define a third pivot and being pivotally connected to the main lift link to define a fourth pivot with the third and fourth pivot being located vertically between the first and second pivot throughout movement from the lowered position to the raised position and each of the first, second, third, and fourth pivots being located above the lower portion of the frame at a vertical height that is at least one-half of the height of the work machine or greater.

* * * * *